United States Patent [19]

West

[11] 4,448,535

[45] May 15, 1984

[54] APPARATUS FOR BLENDING ADDITIVES INTO A LIQUID

[75] Inventor: Joe E. West, Coppell, Tex.

[73] Assignee: The Western Company of North America, Fort Worth, Tex.

[21] Appl. No.: 330,949

[22] Filed: Dec. 15, 1981

[51] Int. Cl.[3] ..... B01F 15/02; B01F 7/04

[52] U.S. Cl. ..... 366/13; 366/21; 366/29; 366/30; 366/42; 366/132; 366/153; 366/168; 366/174; 366/191; 366/302

[58] Field of Search ..... 366/8, 16, 20, 10, 21, 366/27, 28, 30, 33, 34, 35, 38, 40, 64, 66, 167, 168, 174, 191, 302, 306, 307, 336, 338, 13, 153; 137/801; 239/533.1; 251/155

[56] References Cited

U.S. PATENT DOCUMENTS

| | | | |
|---|---|---|---|
| 2,126,911 | 8/1938 | Mullen | 366/167 X |
| 2,298,258 | 10/1942 | Ziler | 366/35 |
| 2,664,277 | 12/1953 | Davies | 366/27 |
| 2,733,053 | 1/1956 | Dugas | 366/40 X |
| 3,206,174 | 9/1965 | Young | 366/8 |
| 4,158,501 | 6/1979 | Smith et al. | 366/16 |
| 4,285,601 | 8/1981 | Miner | 366/174 X |
| 4,298,288 | 11/1981 | Weisbrod | 366/8 |

*Primary Examiner*—Philip R. Coe
*Assistant Examiner*—Arthur D. Dahlberg
*Attorney, Agent, or Firm*—Richards, Harris & Medlock

[57] ABSTRACT

Disclosed is an apparatus for blending sand and solid additives selectively and at selected rates into water for injection into a well. The apparatus may be truck mounted, and includes a frame, an input line with manifold and pump, a mixing tank, a variable venturi nozzle for delivering water to the tank, and an output line with pump, manifold, and recycle line. An auger delivers sand to the mixing tank. Dry chemicals are fed to the tank adjacent the variable venturi nozzle where the water is turbulent, at low pressure, and in high shear. Liquid chemicals may also be pumped into the tank.

19 Claims, 8 Drawing Figures

APPARATUS FOR BLENDING ADDITIVES INTO A LIQUID

BACKGROUND OF THE INVENTION

In the treatment of oil bearing formations to stimulate oil production, one technique involves injection of water at high pressure into selected wells in the formation. The water desirably contains sand in selected proportions and in accordance with various other techniques, polymers or other chemicals are added to the water in liquid or solid form. The modified water is then delivered into the selected wells, preferably at elevated pressures.

Since sand is not soluble, the sand bearing water must be kept in a sufficient state of agitation during the course of its delivery into the formation, and must be initially agitated to create the desired suspension of sand in the water. Gelling agents, added as dry powders, are employed to increase the suspendability of the sand. Other dry powders, termed "polymers" are also often added to modify the water.

The dry chemicals, of whatever type, need to be readily and thoroughly wet and dispersed in the water to provide a uniform solution. One undesired effect of some prior methods of introducing dry powders into the water is the formation of agglomerates of dry chemical surrounded by a gelled mixture of water and powder, such agglomerates sometimes being referred to as "fish eyes". Such agglomerates are, of course, undesirable in the formation or in the well bore. In order to form good solutions or suspensions of dry chemicals, is desirable to introduce them into zones of high turbulence, low pressure, and high shear in the water.

In the delivery of water into a tank for mixing sand and chemicals into it, it is desirable to be able to separately influence the flow rate, delivery pressure, and linear velocity of the incoming water, in order to optimize the mixing conditions in the mixing vessel. Particularly, it is desirable to be able to independently control volumetric flow rate and linear velocity, since field applications may require widely varying volumetric flow rates, while a fairly narrow range of linear velocities is optimum for carrying out the mixing function.

SUMMARY OF THE INVENTION

In accordance with the invention there is provided an apparatus for blending sand and solid additives selectively and at selected rates into water, primarily for injection into a well leading to a producing formation. The apparatus desirably includes a frame, and blending tank mounted on the frame. A water intake line on the frame is adapted to receive water from a source, such as a well or tank, which is located off the frame, and for delivering the water so received to the blending tank. The water intake line has a pump in it.

A slurry output line is also provided on the frame for receiving water from the blending tank and for delivering it to and into a well. The slurry output line also has a pump in it. Means are provided for delivering sand into the blending tank, and in the preferred embodiment these means involve one or more augers. Also provided are means for delivering solid additives, such as powdered chemicals into the blending tank.

In accordance with the preferred embodiment, the water intake line mentioned above terminates in a downwardly oriented nozzle at the blending tank and the solid additive delivery means are constructed and arranged to deliver the additive into the blending tank immediately adjacent the water intake line nozzle. All of the water fed to the tank passes through said nozzle, so that the turbulence, violence, and high shear of all of the water at the nozzle contributes to the dissolving of the solid additive.

It is also preferred that means be provided for delivering liquid additives into the water in the blending tank.

The nozzle preferably comprises a flexible tube mounted on the end of the water intake line and a control bar which is mounted adjacent the flexible tube in a position to press against it to deform the tube and thus vary its area. As the area of the tube is varied, the linear velocity of the water moving through the tube will also vary even though the volumetric flow rate may remain constant. The blending tank has baffles which partition off a part of a portion of the upper part of the tank, and the nozzle is positioned to discharge into that partioned off portion. Furthermore, the blending tank is generally rectangular in plan and the partitioned off portion is located at one corner of the tank and in addition the output line is connected to the tank at the other end of the tank from the partioned off portion. The tank has agitation means in the blending tank which also serve to propel the water in the tank toward the output line connection. Additional baffles are provided to direct the water leaving the partitioned off section of the tank toward the output line connection in a generally spiral flow path.

The entire apparatus as thus far described may be truck mounted, preferably on a truck having off-the-road capabilities. The truck is provided with an engine, which may also be used for propulsion purposes, or which may be used only for powering the equipment just described. In any event, the unit has a hydraulic pump drivingly connected to the engine and hydraulic motors for driving the intake and outake pumps, the sand delivery equipment, the solid additive delivery equipment and the liquid chemical pumps. The primary mode of control may be by means of valves and throttles in the hydraulic lines connecting the hydraulic pump to the various hydraulic motors.

The means for delivering sand into the blending tank on the blending truck preferably includes a sand receiving bin at the rear of the truck and a sand lifting auger (or augers) extending from within the bin to a point above the blending tank from which the sand spills into the agitated water moving through the tank. The bin is preferably mounted on the truck for movement between a raised travelling position and a lowered sand receiving position.

In accordance with one embodiment, the sand and chemical blending tank is oriented longitudinally of the truck along one side thereof and the sand receiving bin is moved to its raised position by pivoting it on the truck, thereby also pivoting the auger downwardly beside the blending tank.

From the foregoing it can be seen that the principal object of the present invention is the provision of a sand and chemical blending apparatus which is simple, effective, flexible and sturdy for use in water-stimulating oil flow in oil formations to increase production therefrom.

The manner in which this object, together with other objects and purposes is achieved can best be understood by a consideration of the detailed description which follows together with the accompanying drawings.

DESCRIPTION OF THE PREFERRED EMBODIMENTS

Figure 1:
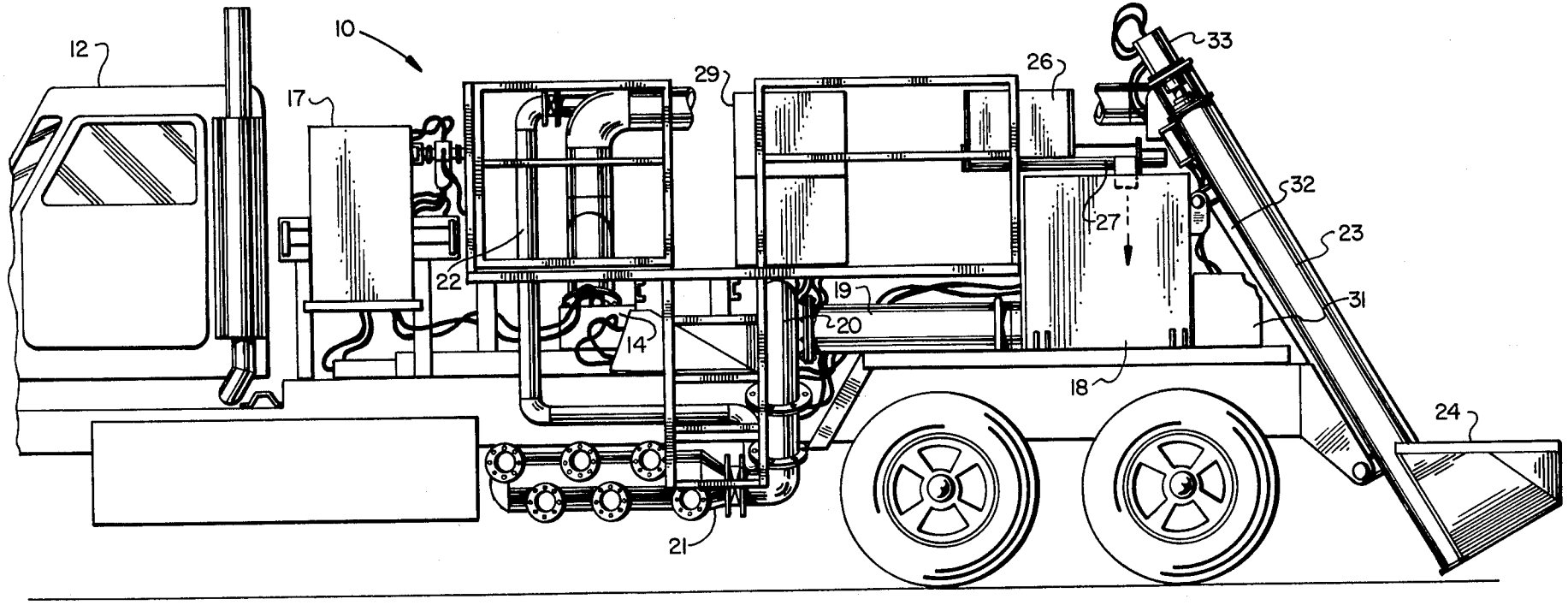
FIG. 1 is a side elevational view, partly broken away, of a truck mounted blending apparatus constructed in accordance with one preferred embodiment of the invention.
Figure 2:
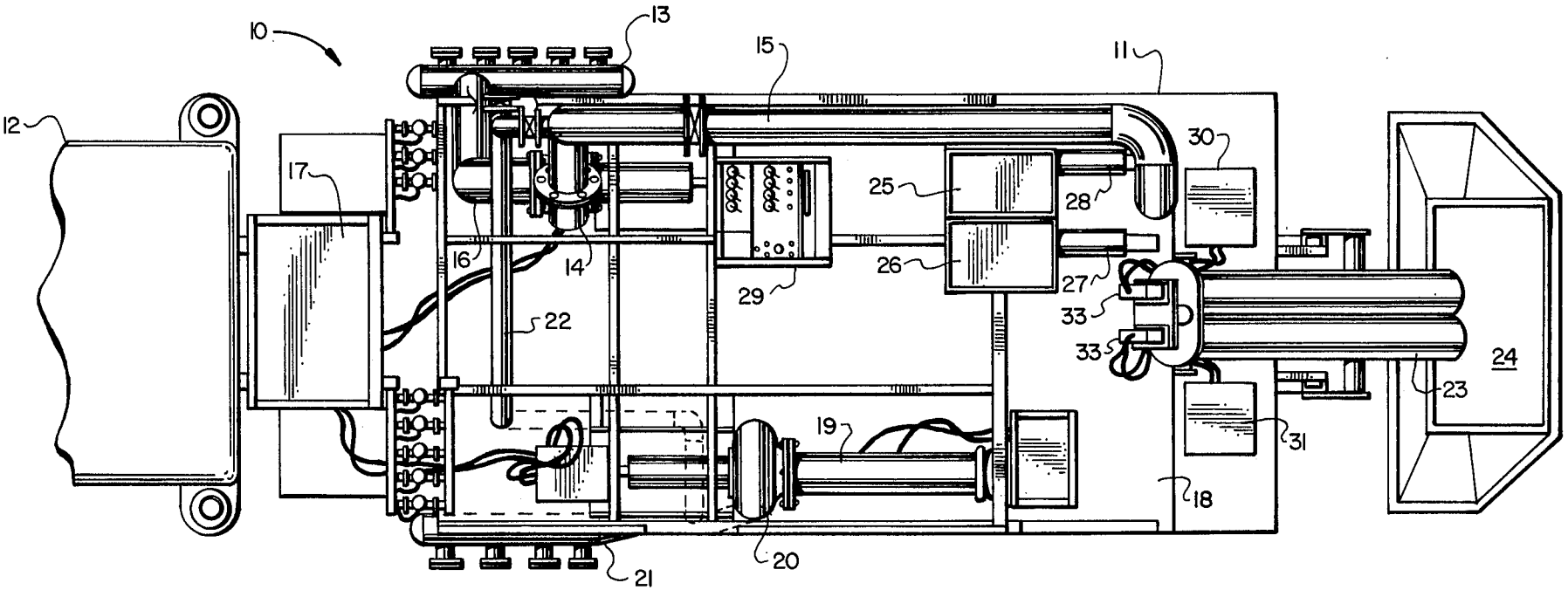
FIG. 2 is a top plan view, partly broken away, of the truck mounted sand blending apparatus of FIG. 1.
Figure 3:
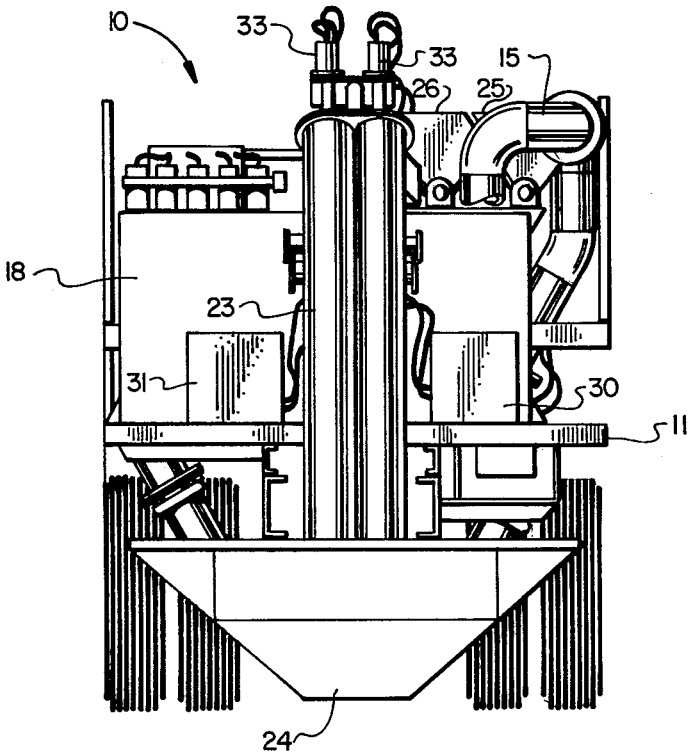
FIG. 3 is a rear elevational view of the truck mounted blending apparatus of FIG. 1.

Attention is first directed to FIGS. 1–3 in which the apparatus of the invention is designated generally as 10. It includes a frame 11 which is mounted on truck 12.

The apparatus includes an intake manifold 13, an intake pump 14 and intake pump line 15. The pump is driven by hydraulic motor 16, which is in turn powered by hydraulic pump 17, which may be driven by the engine of truck 12 or by a separate auxilary engine (not shown). The intake line leads to and terminates at blending tank 18, which is a generally rectangular tank. The output line 19 leads from tank 18 through output pump 20 to output manifold 21. A recycle line 22 is connected between the output line and the input line. A twin screw sand delivery auger 23 is mounted at the back of the truck for lifting sand from a bin 24 to the blending tank 18. Dry chemical supply bins 25 and 26 are mounted above tank 18 and screw type feed pumps 27 and 28 feed chemicals from the storage bins into tank 18 at a point near the delivery point of intake line 15.

A control panel and station 29 is provided for controlling, primarily through hydraulic throttles and valves, the operation of the equipment just described.

At the rear of the frame a pair of liquid additive pumps are shown diagrammatically at 30 and 31; these pumps are positioned to deliver liquid additives into blending tank 18.

In operation, water is drawn into the unit through manifold 13 from one or more sources such as wells, reservoirs or tanks and is pumped by pump 14 into blending tank 18. Simultaneously, the auger 23 delivers sand into the tank at a rate selected to give the desired ratio of sand to water. Also simultaneously, augers 27 and 28 in the dry chemical additive delivery systems operate to feed in dry chemicals into tank 18, and pumps 30 and 31 supply liquid chemicals into the blending tank. The course of the water through the blending tank is turbulent, as will be explained more fully hereinbelow. Water leaves the blending tank through output line 19 under the influence of pump 20 and leaves the unit through manifold 21 through which it is directed to one or more injection wells.

Water level in the tank is maintained and controlled by correlating the speed of the input pump with the speed of the output pump. It should be noted that there is thus no flow controlling valve in the input line for the input pump to work against, so basically all of the energy developed by that pump is devoted to mixing in the tank. Among other things, this means fewer horsepower per gallon are expended in forming and delivering the slurry.

It should be noted that blending tank 18 is mounted crosswise of the truck, and that as FIGS. 1–3 are drawn, the sand bin 24 is in its lowered position for receiving sand from other equipment. For road travel, sand bin 24 is desirably raised by raising augers 23 on rail 32. It should also be noted that augers 23 are provided with hydraulic motors 33.

Figure 4:
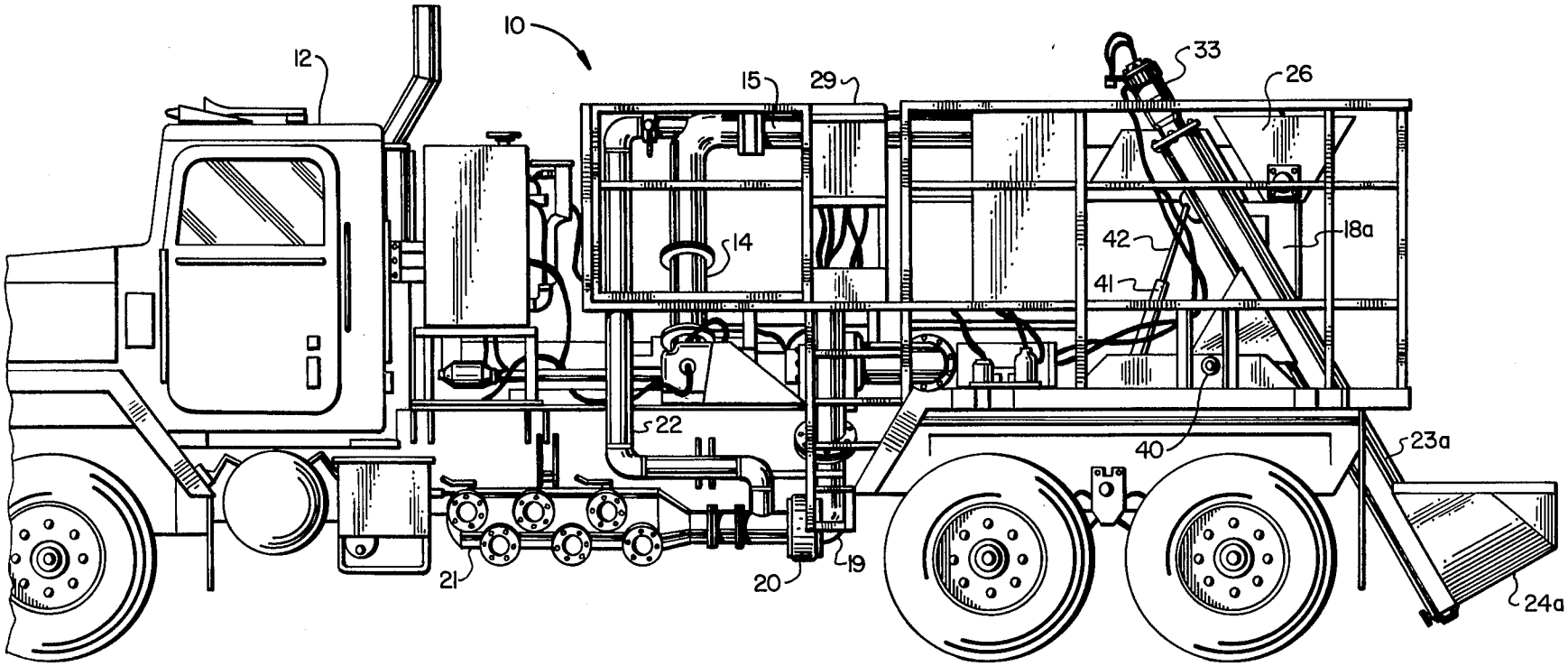
FIG. 4 is a side elevational view, partly broken away, of another embodiment of a truck mounted blending apparatus constructed in accordance with the invention.
Figure 5:
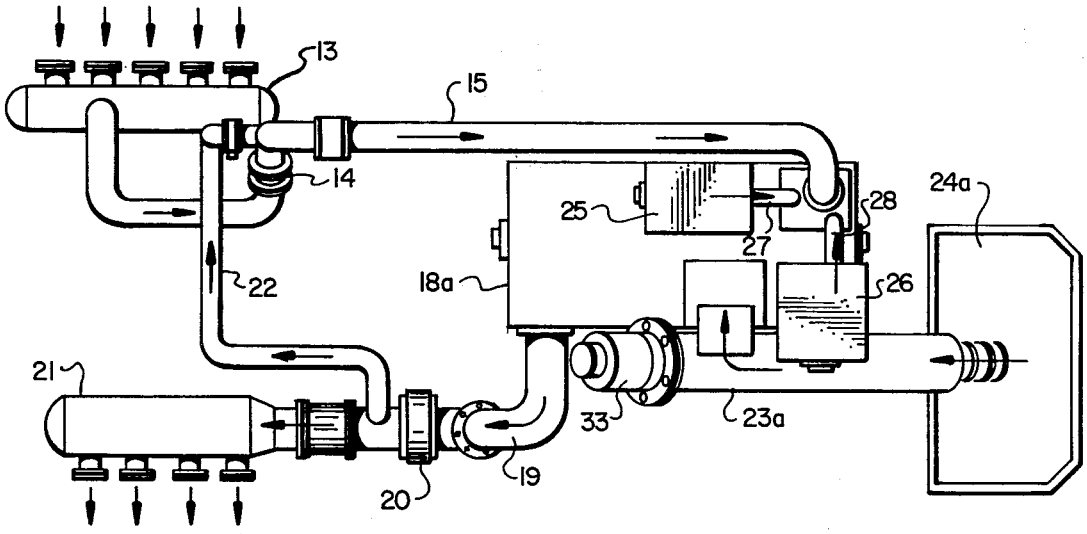
FIG. 5 is a simplified top plan view of a portion of the apparatus of FIG. 4, arranged to show flow paths of material therethrough.

Attention is now directed to FIGS. 4 and 5 which show an alternate embodiment of the invention, which is in many respects similar to the embodiment shown in FIGS. 1 through 3, and in which the same reference characters are used for parts serving the same function and having substantially the same structure, reference being made to the foregoing discussion for an understanding of such similar parts. The present discussion will thus concentrate on those respects on which the embodiment of FIGS. 4 and 5 differ from that of FIGS. 1 through 3. In the embodiment of FIGS. 4 and 5 the blending tank **18*a* is oriented longitudinally of the truck, rather than crosswise thereof as was the case in the embodiment of FIG. 1. This arrangement makes it possible to mount auger 23*a* and sand bin 24*a* by means of pivot 36 on the frame. By providing an hydraulic cylinder 37 and ram 38 between the frame and the auger 23*a*, means are provided for tilting auger 23*a* and sand bin 24*a* on the frame to raise the sand bin for travel purposes. The auger 23*a* pivots on the truck to a point beside or next to blending tank 18*a***.

The flow paths through the equipment can be understood with particular clarity by consideration of FIG. 5. Water enters the unit through manifold 13 and is pumped by pump 14 through line 15 into blending tank **18*a*. Sand is lifted by auger 23*a* from bin 24*a* and is deposited into the top of tank 18*a*. Simultaneously, dry chemicals from bins 25 and 26 are delivered by screw augers 27 and 28 into blending tank 18*a*. Water with sand and chemicals in it leaves tank 18*a* through output line 19 under the influence of pump 20 which delivers it to manifold 21 for distribution to injection wells, or to recycle line 22 which returns it to intake line 15**.

Figure 6:
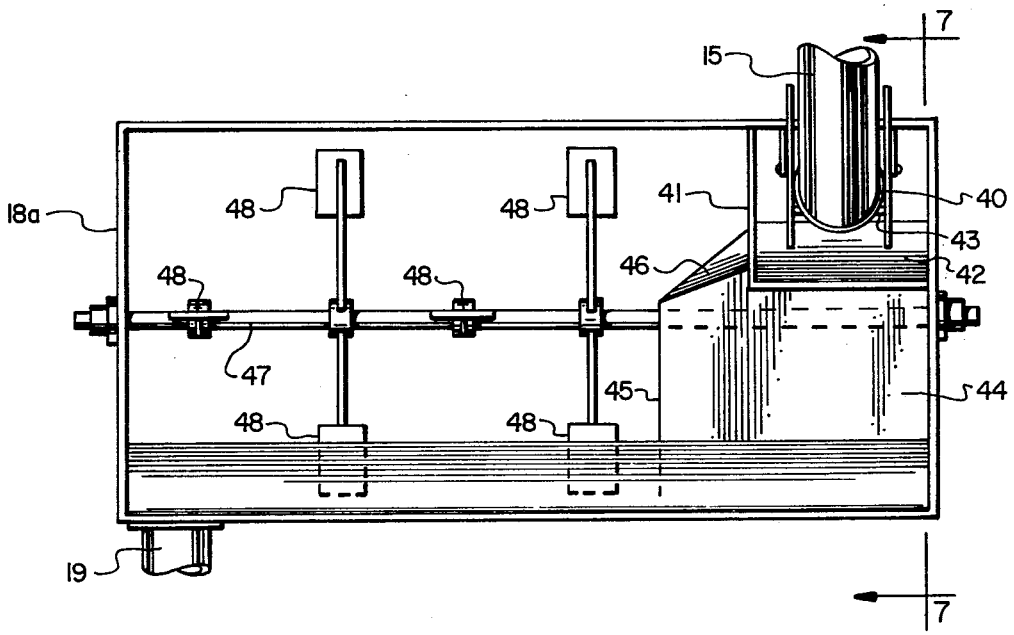
FIG. 6 is a plan view, with the top removed, of a blending tank of the kind used in the apparatus of FIGS. 4 and 5.
Figure 8:
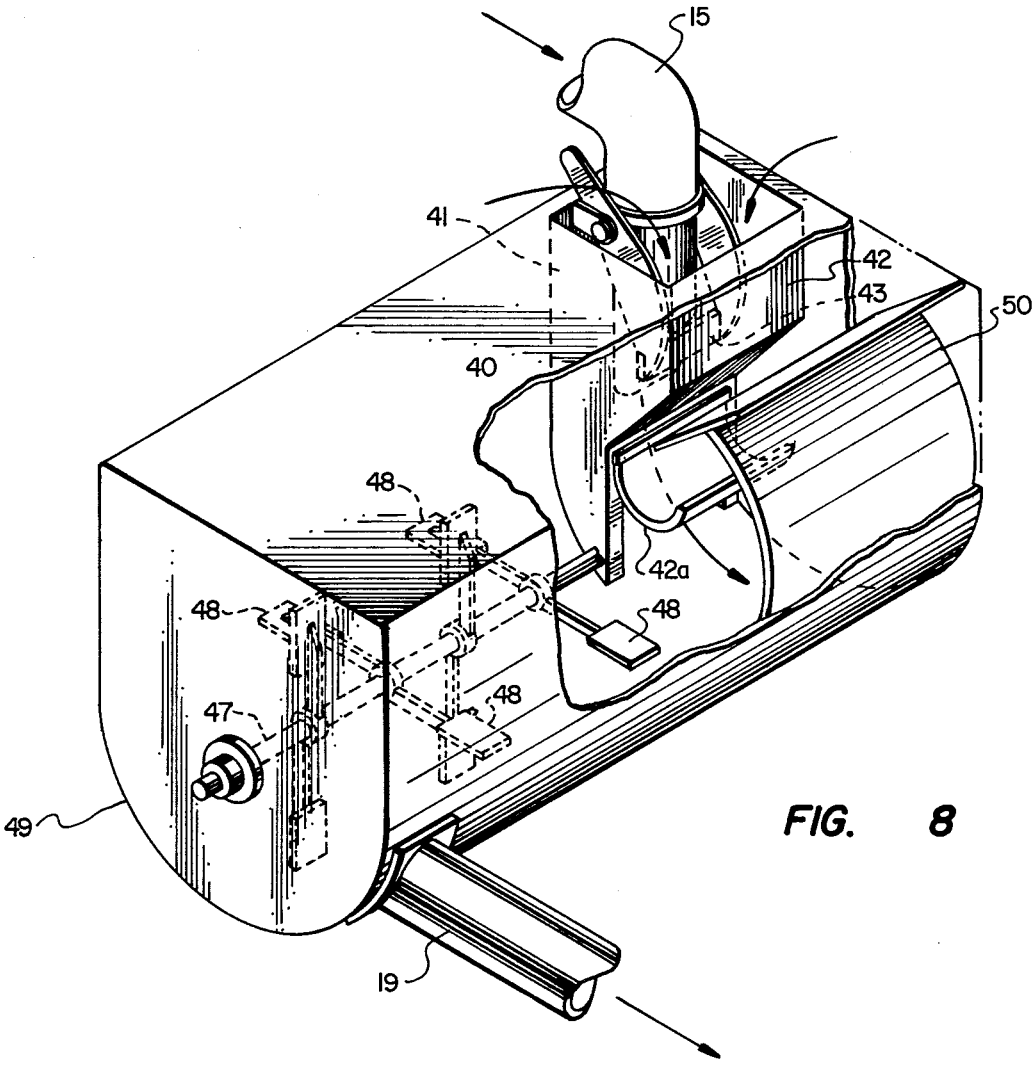
FIG. 8 is a perspective view of the blending tank of FIGS. 6 and 7, with some portions broken away, and with some parts omitted for the sake of simplicity in illustration.
Figure 7:
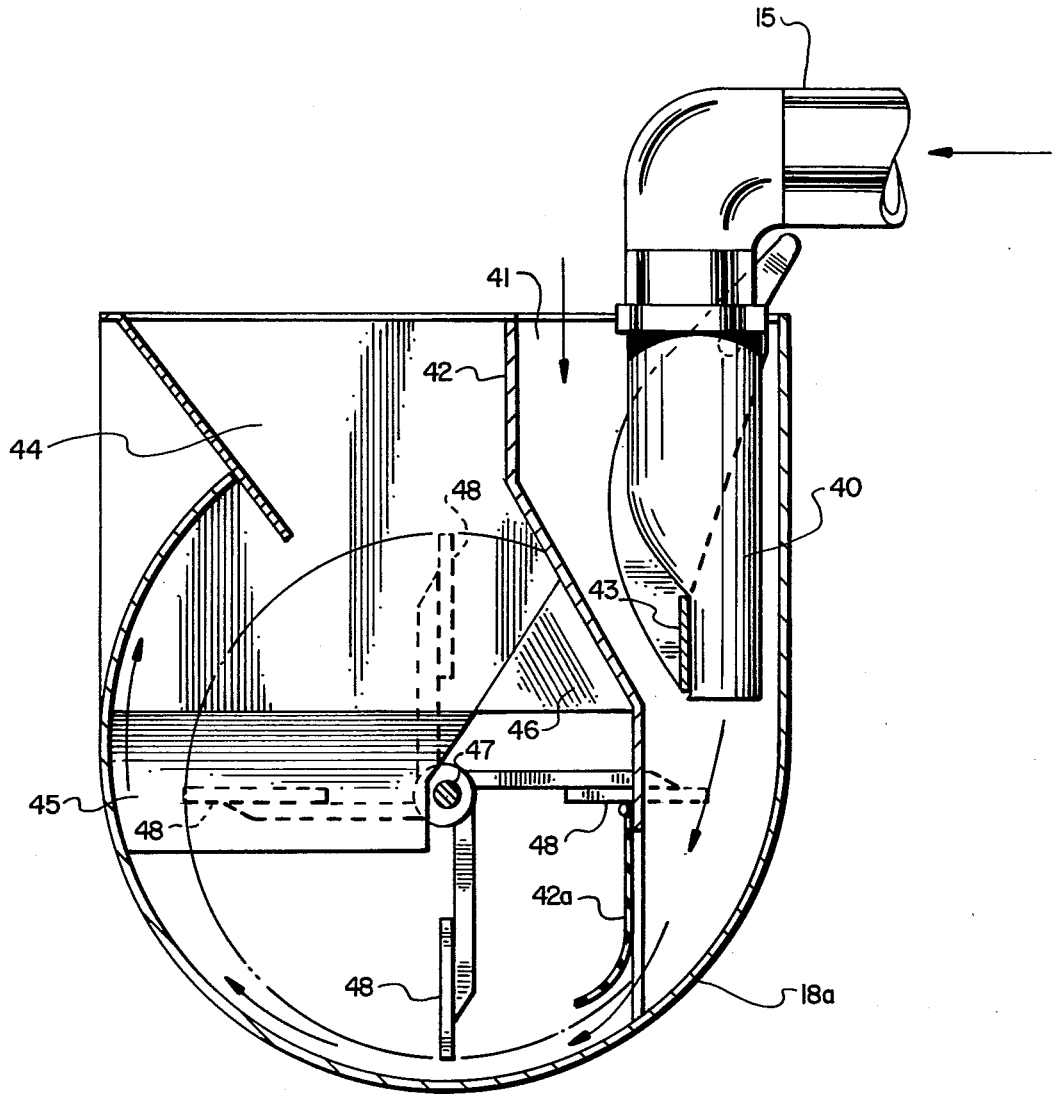
FIG. 7 is an end sectional elevational view of the blending tank of FIG. 6, the section being taken on the line 7—7 of FIG. 6.

Attention is now directed to FIGS. 6, 7 and 8 which show some of the features of the blending tank in accordance with the invention. The tank shown in these figures is tank **18*a* of the embodiment of FIG. 4, but tank 18 of the embodiment of FIG. 1 is in many respects substantially identical, differing only in directions of water rotation and such matters. Water intake line 15 terminates in a downwardly oriented nozzle 40 which issues into a portion of tank 18*a* which is partitioned off as by partition walls 41 and 42. Nozzle 40 is in the form of a flexible hose, and a pivoted press bar 43 is power actuated to push against the flexible hose of nozzle 40 to distort it and alter its area. As is known, in accordance with Bernoulli's principle, the linear velocity of liquid moving through nozzle 40** will be a function of the cross sectional area.

The bottom part of partition 42 is furnished by a flexible flap 42*a* (see FIGS. 7 and 8), which serves to prevent back flow. Water issues through nozzle 40 into the partitioned off portion of tank 18*a* as defined by partitions 41, 42 and 42*a* and then flows into the tank proper under flap 42*a*. It then wells up into tank 18*a* and is directed by partitions 44, 45 and 46 into a portion of tank 18*a* axially displaced from the partitioned off portion wherein the nozzle terminates. The water moves in a generally spiral or overturning path, a flow path which has been found effective in promoting formation of good and uniform slurries or suspensions. An axle 47 running through tank 18*a* carries stirrers 48 for providing additional agitation of water coursing through the tank. The dry chemicals fed by augers 27 and 28 (see especially FIGS. 2 and 5) are fed into the partitioned off portion of the tank 18 defined by partitions 41 and 42. The chemicals fall from augers 27, 28 into a region of low pressure immediately adjacent the nozzle 40. This region is also a region of highly turbulent liquid flow in the water and is also a region of high shear in the water. The violent effect of these three factors on the powdered chemical falling into the water at a point immediately adjacent the nozzle is to assure complete dispersion, and solution if the chemical is soluble in water, so that a uniform solution or dispersion is readily formed. In particular, the above mentioned "fish eyes" which are undesirable and wasteful of material are avoided entirely. It should further be noted that the bottom and one side wall of tank 18*a* are developed into cylindrical surfaces to facilitate turbulent liquid flow through the tank, as appears most clearly at 49 and 50 in FIG. 8.

The linear velocity of water flowing through nozzle 40 may be maintained substantially constant, or at least within a suitably narrow range, by varying the area of the nozzle, to compensate for changes in the volume flow rate through line 15 and or in the pressure developed by pump 14 intake line 15. Thus, conditions conducive to good mixing and good solution of the dry chemicals introduced through augers 27 and 28 can be maintained even though flow rate may vary. Similarly, the high turbulence and local violence in the water which is conducive to good dispersion and suspension of the sand being introduced into tank 18*a* can also be obtained even though flow rate may vary.

From the foregoing it can be seen that the present invention provides a simple and effective set of mixing apparatus for blending sand, dry chemicals, and liquid chemicals if desired, into water for use in stimulating oil production from wells.

I claim:

1. Apparatus for blending a high volume flow of sand and solid additives, selectively and at selected rates, into water for injection into a well comprising:

a frame;

a blending tank on said frame;

a water intake line on said frame for receiving water from a source off said frame and delivering it to said blending tank, said water intake line having a pump therein;

said water intake line terminating in a downwardly oriented nozzle at said blending tank through which all water delivered to said tank flows; and means for delivering said sand into said blending tank adjacent said nozzle and disposed for delivering said sand directly into the flow of said water issuing through said nozzle;

means for delivering solid additives into said blending tank, said solid additive delivery means being constructed and arranged to deliver additive into said blending tank adjacent said nozzle and disposed for delivering said solid additive directly into the flow of said water issuing through said nozzle;

whereby the turbulence, violence, low pressure and high shear of all of said water issuing through said nozzle effects dispersion and solution of said sand and solid additives.

2. Apparatus in accordance with claim 1 and further comprising means for delivering liquid additives into said blending tank.

3. Apparatus in accordance with claim 2 in which said nozzle comprises a flexible tube mounted on the end of said water intake line, and a control bar movably mounted adjacent said tube in position to press thereagainst to thereby vary the area of the tube by deforming it.

4. Apparatus in accordance with claim 2 and further comprising:

an output line connected to said blending tank for drawing water with sand and additives therein from said blending tank;

an output line pump within said output line;

a wheeled truck having an engine, said frame being mounted on said truck;

a hydraulic pump mounted on said truck and drivingly connected to said engine;

hydraulic motors for driving said intake line and output line pumps, said sand delivery means, said solid additive delivery means, and said liquid additive delivery means;

hydraulic lines connecting said motors and said hydraulic pump; and motor controls in said hydraulic lines.

5. Apparatus in accordance with claim 1 in which said nozzle is variable in area whereby the linear velocity of the water expelled therethrough is controlled.

6. Apparatus in accordance with claim 1 in which said blending tank has a baffle therein partitioning off a portion of the upper part of said tank, and in which said nozzle is positioned to discharge into said partitioned off portion.

7. Apparatus in accordance with claim 6 in which said blending tank is generally rectangular in plan, in which said partitioned off portion is adjacent one corner thereof, and in which said output line is connected to said tank at an end of said tank remote from said partitioned off portion.

8. Apparatus in accordance with claim 7 and further comprising agitation means in said blending tank adapted to propel water therein toward said remote end.

9. Apparatus in accordance with claim 7 and further comprising:

baffles means for directing water discharged through said nozzle into said partitioned off portion in a generally spiral path about a substantially horizontal axis through the balance of said tank to the slurry output line; and agitation means in said blending tank adapted to promote the continuation of the generally spiral path of water through the balance of said tank after discharge from said nozzle.

10. Apparatus in accordance with claim 6 and further comprising baffles means for directing water discharged through said nozzle into said partitioned off portion in a generally spiral path through the balance of said tank.

11. Apparatus in accordance with claim 1 and further comprising:

an output line connected to said blending tank for drawing water with sand and additives therein from said blending tank;

an output line pump within said output line; and variable speed controls on said intake line and output line pumps for controlling water level in said tank by correlating pump speeds.

12. Apparatus in accordance with claim 11 and further comprising:

a wheeled truck having an engine, said frame being mounted on said truck;

a hydraulic pump mounted on said truck and drivingly connected to said engine;

hydraulic motors for driving said intake line and output line pumps, said sand delivery means, and said solid additive delivery means;

hydraulic lines connecting said motors and said hydraulic pump; and motor controls in said hydraulic lines.

13. Apparatus in accordance with claim 1 in which said frame is mounted on a truck and in which said means for delivering sand into said blending truck comprises a sand receiving bin at the rear of said truck and a sand lifting auger extending from within said bin to a point above said blending tank.

14. Apparatus in accordance with claim 13 in which said bin is mounted on said truck for movement between a raised travelling position and a lowered sand receiving position.

15. Apparatus in accordance with claim 14 in which said blending tank is oriented longitudinally of said truck along one side thereof and in which said bin is moved to its raised positioned by pivoting it on said truck, thereby also pivoting said auger downwardly beside said blending tank.

16. A blending apparatus for blending dry chemicals into a stream of flowing water in route to injection into a well comprising:

a generally rectangular blending tank having a baffle therein partitioning off a portion of the upper part of said tank adjacent one corner of said tank;

an intake line for delivering water to said tank, said line terminating in a downwardly oriented nozzle of selectively variable area positioned within the partioned off portion of said tank;

an output line connected to said blending tank at an end thereof remote from said partitioned off portion for drawing chemical-bearing water from said blending tank and delivering it toward a well;

means for selectively varying the area of said intake line nozzle whereby the linear velocity of the water expelled therethrough is controlled;

means for feeding dry chemicals into said partioned off portion of said tank adjacent said nozzle; and agitator means in said blending tank.

17. Apparatus in accordance with claim 16 in which said nozzle comprises a length of flexible tubing mounted at the end of said intake line, and said means for varying the area of said intake nozzle comprises a movable bar positioned to press said flexible tubing against a wall of said tank to adjust the area of said nozzle to the desired value.

18. Apparatus for blending sand and solid additives, selectively and at selected rates into water for injection into a well comprising:

a frame;

a wheeled truck having an engine, said frame being mounted on said truck;

a hydraulic pump mounted on said truck and drivingly connected to said engine;

a generally rectangular blending tank on said frame, said blending tank having a baffle therein partitioning off a portion of the upper part of said blending tank adjacent one corner of said blending tank;

means for delivering liquid additives into said blending tank;

a water intake line on said frame for receiving water from a source off said frame and delivering it to said blending tank, said water intake line having a pump therein;

a slurry output line on said frame and connected to said blending tank at an end of said blending tank remote from said partitioned off portion, said slurry output line being disposed for receiving water from said blending tank and delivering it to a well, said slurry output line having a pump therein;

agitation means in said blending tank adapted to propel water therein toward said remote end;

a sand receiving bin at the rear of said truck, said bin being mounted on said truck for movement between a raised travelling position and a lowered sand receiving position;

a sand lifting auger extending from within said bin to a point above said blending tank;

said water intake line terminating in a downwardly oriented nozzle at said blending tank through which all water delivered to said tank flows, said nozzle comprising:

a flexible tube mounted on the end of said water intake line; and a control bar movably mounted adjacent said tube in position to press thereagainst to thereby vary the area of the tube by deforming it;

means for delivering solid additives into said blending tank, said solid additive delivery means being constructed and arranged to deliver additive into said blending tank adjacent said nozzle whereby the turbulence, violence, low pressure and high shear of all of said water issuing through said nozzle effects dispersion and solution of said sand and solid additives;

baffles means for directing water discharged through said nozzle into said partitioned off portion in a generally spiral path through the balance of said tank;

hydraulic motors for driving said intake and output pumps, said sand lifting auger, and said additives delivery means;

hydraulic lines connecting said motors and said hydraulic pumps;

variable speed motor controls in said hydraulic lines for controlling the water level in said blending tank by correlating pump speeds; and said bin being oriented longitudinally of said truck along one side thereof and in which said bin is moved to its raised position by pivoting it on said truck, thereby also pivoting said auger downwardly beneath said blending tank.

19. Apparatus for blending a high volume flow of sand and solid additives, selectively and at selected rates, into water for injection into a well comprising:

a frame;

a wheeled truck having an engine, said frame being mounted on said truck;

a hydraulic pump mounted on said truck and drivingly connected to said engine;

a generally rectangular blending tank on said frame, said blending tank having a baffle therein partitioning off a portion of the upper part of said blending tank adjacent one corner of said blending tank;

means for delivering fluid additives into said blending tank;

a water intake line on said frame for receiving water from a source off said frame and delivering it to said blending tank, said water intake line having a pump therein;

a slurry output line on said frame and connected to said blending tank at an end of said blending tank remote from said partitioned off portion, said slurry output line being disposed for receiving water from said blending tank and delivering it to a well, said slurry output line having a pump therein;

agitation means in said blending tank adapted to propel water therein toward said remote end;

a sand receiving bin at the rear of said truck, said bin being mounted on said truck for movement between a raised travelling position and a lowered sand receiving position;

a sand lifting auger extending from within said bin to a point above said blending tank;

said water intake line terminating in a downwardly oriented nozzle at said blending tank through which all water delivered to said tank flows, said nozzle comprising:

a flexible tube mounted on the end of said water intake line; and a control bar movably mounted adjacent said tube in position to press thereagainst to thereby vary the area of the tube by deforming it whereby the linear velocity of the water expelled therethrough is controlled;

means for delivering said additives into said blending tank, said solid additive delivery means being constructed and arranged to deliver additive into said blending tank adjacent said nozzle and disposed for delivering said solid additive directly into the flow of said water issuing through said nozzle;

baffles means for directing water discharged through said nozzle into said partitioned off portion in a generally spiral path through the balance of said tank;

whereby the turbulence, violence, low pressure and high shear of all of said water issuing through said nozzle effects dispersion and solution of said sand and solid additives;

hydraulic motors for driving said intake and output pumps, said sand lifting auger, and said additives delivery means;

hydraulic lines connecting said motors and said hydraulic pumps;

variable speed motor controls in said hydraulic lines for controlling the water level in said blending tank by correlating pump speeds; and said bin being oriented longitudinally of said truck along one side thereof and in which said bin is moved to its raised position by pivoting it on said truck, thereby also pivoting said auger downwardly beneath said blending tank.

* * * * *